United States Patent [19]

Arifoglu et al.

[11] Patent Number: 5,017,194

[45] Date of Patent: May 21, 1991

[54] SEQUENTIAL OXIDATIVE AND REDUCTIVE BLEACHING OF PIGMENTED AND UNPIGMENTED FIBERS

[75] Inventors: Mustafa Arifoglu, Wyndmoor; William N. Marmer, Fort Washington, both of Pa.

[73] Assignee: The United States of America, as represented by the Secretary of Agriculture, Washington, D.C.

[21] Appl. No.: 446,826

[22] Filed: Dec. 6, 1989

Related U.S. Application Data

[63] Continuation-in-part of Ser. No. 299,174, Jan. 19, 1989.

[51] Int. Cl.[5] ..... D06L 3/02

[52] U.S. Cl. ..... 8/111; 8/110

[58] Field of Search ..... 8/111, 108

[56] References Cited

FOREIGN PATENT DOCUMENTS 3433926 3/1986 Fed. Rep. of Germany .
51-64082 6/1976 Japan .

OTHER PUBLICATIONS

Fleet, M. R., Pigmented Fibres in White Wool, Wool Technology and Sheep Breeding 33, 5-13, 1985.

Fleet, M. R. et al., Contamination of White Wool by Melanin-pigmented Fibres when Pigmented and White Sheep Graze Together, Aust. J. Exp. Agric. 26, 159-163, 1986.

Foulds, R. A. et al., Dark Fibres and Their Economic Importance, Wool Technology and Sheep Breeding 32(2), 91-100, 1984.

Nolan, C. and Foulds, R., Dard-fibre Contamination in Wool, Queensland Agricultural J., Nov.-Dec., 305-307, 1985.

Turner, T. R. and Foulds, R. A., Decision Schemes for Assessing Dark Fiber Concentration in Top, Textile Res. J. 57(12), 710-720 (1987).

Wolfram, L. J. and Albrecht, L., Chemical and Photo--Bleaching of Brown and Red Hair, J. Soc. Cosmet. Chem. 82, 179-191, 1987.

Wolfram, L. J. et al., The Mechanism of Hair Bleaching, J. Soc. Cosmet. Chem. 21, 875-900, 1970.

Zahn, H. et al., Bleaching and Permanent Waving Aspects of Hair Research, J. Soc. Cosmet. Chem. 37, 159-175, 1986.

(List continued on next page.)

*Primary Examiner*—Paul Lieberman
*Assistant Examiner*—John F. McNally
*Attorney, Agent, or Firm*—David R. Sadowski; M. Howard Silverstein

[57] ABSTRACT

The present invention is drawn to new processes for sequential oxidative and reductive bleaching of pigmented and unpigmented fibers (e.g. natural, synthetic, or blends thereof) e.g. in a single bath, which provide superior bleaching with less physical damage. Said processes including processes comprised of: (1) adsorption of ferrous ions by pigmented and unpigmented fibers; (2) removing a portion of the ferrous ions from the fibers, with at least a portion of the ions remaining on the pigmented fibers; (3) contacting the fibers with hydrogen peroxide to provide oxidative bleaching including bleaching by interaction with the ferrous ions; (4) adding either (a) a material which combines with hydrogen peroxide to form a reductive beaching agent, or (b) an inactivating material to inactivate unspent hydrogen peroxide with subsequent addition of a reductive bleaching agent, and; (5) reductively bleaching the already oxidatively bleached fibers. The aforementioned processes provide the advantages of preventing deposition of ferric species and producing fibers which are essentially free of iron residue. The present invention also encompasses processes employing hydrogen peroxide and at least one persulfate containing compound, rather than the aforementioned iron-mordanting. The instant invention produces fibers having surprising, highly advantageous, and desirable properties, e.g. fibers which are essentially pigment free, have a high degree of whiteness with low degree of damage.

14 Claims, 7 Drawing Sheets

OTHER PUBLICATIONS

Bereck, A., Bleaching of Dark Fibres in Wool, Proc. 7th Int. Wool Res. Conf., Tokyo, vol. IV, 152–162, 1985.

Bereck, A. and Kaplin, J. J., Electron-Microscope Observations on the Disintegration of Melanin Granules in Chemically Treated Karakul Wool, J. Textile Inst. 74, 44–47, 1983.

Bereck, A. et al., Das Selective Bleichen von Pigmentierten Haaren in Rohweisser Wolle, Textil Praxis Int. 37, 621–629, 1982.

Finnimore, E. and Bereck, A., Verhalten von Selectiv Gebleichter Wolle, Melliand Textiberichte 68, 669–672 (English translation, E291–292), 1987.

Kriel, W. J., Melanin-bleeding of Pigmented Wool, SAWTRI (South African Wool Textile Research Inst.), Bulletin 3(1), 16–20, 1969.

Laxer, G. and Whewell, C. S., Some Physical and Chemical Properties of Pigmented Animal Fibres, Proc. Int. Wool Res. Conf. Aust., vol. F, 186–200, 1955.

Teasdale, D. C. and Bereck, A., The Measurement of the Color of Bleached and Natural Karakul Wool, Textile Res. J. 51, 541–549, 1981.

VanHeerden, N. et al., Bleaching of Karakul Wool, SAWTRI (South African Wool Textile Research Inst.), Bulletin 3(4), 21–23, 1969.

Corbett, J. F., The Chemistry of Hair-Care Products, J. Soc. Dyers Colour, 92, 285–303, 1976.

Geison and Ziegler, Die Absorption von Eisen durch Wolle und Haar, Melliand Textilberichte, 62, 482–483 (English Translation, E622–625), 1981.

Textile Terms and Definitions, 5th ed., publ. Textile Institute, Aug. 1963.

W. C. Schumb et al., editors, Hydrogen Peroxide, chpt. 8, publ. Reinhold Pub. Corp., NY, 1955.

I.W.T.O. Technical Committee Report, 1960, IWTO-4-60(E).

Ziegler, K., Textil-Praxis, 17, 376(1962).

SEQUENTIAL OXIDATIVE AND REDUCTIVE BLEACHING OF PIGMENTED AND UNPIGMENTED FIBERS

1. CROSS REFERENCE TO RELATED APPLICATION

The present application is a continuation-in-part of application Ser. No. 07/299,174 filed 01/19/89 by Mustafa Arifoglu and William N. Marmer, entitled "Sequential Oxidative and Reductive Bleaching in a Multicomponent Single Liquor System".

2 FIELD OF THE INVENTION

The present invention relates to processes for oxidative (using hydrogen peroxide) and reductive bleaching of fibers, and fibers bleached by the aforementioned processes.

3. BACKGROUND AND SUMMARY OF THE INVENTION

The occurrence of dark (i.e. pigmented and/or stained) fibers often gives rise to annoying and expensive problems for manufacturers at all stages of fiber processing. For example, extensive literature is available on the occurrence of dark fibers in white wool, see e.g.: Fleet, M. R., *Pigmented Fibres in White Wool*, Wool Technology and Sheep Breeding 33, 5–13 (1985); Fleet, M. R., Stafford, J. E., Dawson, K. A., and Dolling, C. H. S., *Contamination of White Wool by Melanin-pigmented Fibres when Pigmented and White Sheep Graze Together*, Aust. J. Exp. Agric. 26, 159–163 (1986); Foulds, R. A., Wong, P., and Andrews, J. W., *Dark Fibres and Their Economic Importance*, Wool Technology and sheep Breeding 32(2), 91–100 (1984), and; Nolan, C., and Foulds, R., *Dark-fibre Contamination in Wool*, Queensland Agricultural J. Nov.–Dec., 305–307 (1985). The degree of contamination of white wool by colored fibers has a significant influence on its commercial value, especially when the wool is to be processed into light or pastel-colored articles. The manual removal of dark fibers is an extremely work- and cost-intensive, eye-straining job.

If the contents of dark fibers in white wool are above an acceptable level for white or pastel end uses, then those dark fibers need to be lightened to improve the appearance and to increase the value of the goods (see in this regard Turner, T. R., and Foulds, R. A., *Decision Schemes for Assessing Dark Fiber Concentration in Top*, Textiles Res. J. 57(12), 710–720 (1987). It is often found that the fibers and sliver of yarn are not tested properly for dark fiber content, and hence these impurities are first seen as dark fibers interwoven into the fabric matrix or in the end product. In such cases the dark fibers have to be removed manually with tweezers. A more convenient and economical alternative is given by the possibility of a wet treatment, which is much more productive and in many cases also less expensive.

The color of dark (i.e. pigmented) fibers ranges from black through shades of brown to light yellow, and the lightening of black fibers needs more severe wet treatment than those of the lighter fibers. Wet treatment conditions, however, should not be so severe as to damage the fibers excessively at the expense of lightening a few black fibers. Therefore, the present invention utilizes a treatment which is selective for areas of high dark fiber content. There have been numerous publications on the bleaching of hair (see e.g. Wolfram, L. J., and Albrecht, L., *Chemical and Photo-bleaching of Brown and Red Hair*, J. Soc. Cosmet, Chem. 82, 179–191 (1987); Wolfram, L. J., Hall, K., and Hui, I., *The Mechanism of Hair Bleaching*, J. Soc. Cosmet. Chem. 21, 875–900 (1970), and; Zahn, H., Hilterhaus, S., and Strussman, A., *Bleaching and Permanent Waving Aspects of Hair Research*, J. Soc. Cosmet. Chem. 37, 159–175 (1986)) and dark wool fibers (see for example, Bereck, A., *Bleaching of Dark Fibres in Wool*, Proc. 7th. Int. Wool Res. Conf., Tokyo, vol. IV, 152–162 (1985); Bereck, A., and Kaplin, J. J., *Electron-microscope Observations on the Disintegration of Melanin Granules in Chemically Treated Karakul Wool*, J. Textile Inst. 74, 44–47 (1983); Bereck, A., Zahn, H., and Schwarz, S., *Das Selective Bleichen von Pigmentierten Haaren in Rohweisser Wolle*, Textil Praxis Int. 37, 621–629 (1982) Finnimore, E., and Bereck, A., Verhalten von selectiv gebleichter Wolle, Melliand Textilberichte 68, 669–672 (English translation, E291–292) (1987); Kriel, W. J., Albertyn, D., and Swanepoel, O. A., *Melanin-bleeding of Pigmented Karakul Wool*, SAWTRI [South African Wool Textile Research Institute] Bulletin 3(1), 16–20 (1969); Laxer, G., and Whewell, C. S., *Some Physical and Chemical Properties of Pigmented Animal Fibres*, Proc. Int. Wool Res. Conf. Australia vol. F, 186–200 (1955); Teasdale, D. C., and Bereck, A., *The Measurement of the Color of Bleached and Natural Karakul Wool*, Textile Res. J. 51, 541–549 (1981), and; Van Heerden, N., Becker, J., van der Merwe, J. P., and Swanepoel, O. A., *Bleaching of Karakul Wool*, SAWTRI [South African Wool Textile Research Institute] Bulletin 3(4), 21–23 (1969)). Laxer and Whewell, Ibid, first realized that black-brown pigmented fibers absorb iron from ferrous sulfate solutions more rapidly and to a greater extent than white fibers, probably owing to the formation of a metal complex with the melanin of the pigment granules. Union between the iron and the fiber is reasonably firm and this bound iron is a useful catalyst for promoting bleaching when the iron-containing fibers are immersed in solutions of hydrogen peroxide.

All known processes for bleaching pigmented dark fibers are based on the use of peroxy compounds, Bereck (1985), Ibid. Wolfram et al (1970), Ibid, have studied the mechanism of hair bleaching in detail. They found that the bleaching reaction occurs in two steps; the initial solubilization of the granules is followed by the decolorization of the dark brown solubilized pigment. The pigment granules are distributed within the cortex (Laxer, Ibid) and therefore the bleaching of the granules is a diffusion-controlled reaction. Some oxidation of the keratin matrix does occur during the bleaching process due to diffusion. Wolfram et at (1970) Ibid, showed that neither reducing agents such as thioglycolic acid; borohydride, sulfide and sulfite, nor some oxidizing agents such as persulfate, perchlorate, iodate and permanganate, produce any apparent physical change in the melanin pigment. A different behavior was displayed by hydrogen peroxide. Dilute aqueous solutions of this reagent caused disintegration of the pigment granules, which slowly dissolved in the reaction system. The dark brown solution gradually became lighter over a long period of time. The second step (decolorization of the melanin granules) is therefore much slower than the first step (solubilization of the melanin pigment) and hence the former is the rate-determining step in the overall process. It was pointed out that the disintegration process alone is unlikely to affect the color of hair significantly; it may cause only a slight change in hue.

The dissolution of melanin in alkali, observed for example in the "bleeding" of pigmented fibers even at only sightly alkaline pH, is a well-known phenomenon, Kriel et al, Ibid. Bereck and Kaplin, Ibid, have studied the disintegration of melanin granules in chemically treated karakul wool using an electron microscope. Their studies revealed the following interesting features. Under identical bleaching conditions, the destruction of the melanin granules was virtually complete in the mordanted wool whereas in the untreated wool the granules were only partly dissolved. These workers have also observed that the electron micrographs of bleached wool were not unlike those of the samples treated with alkali. However, the change in luminosity due to the alkali treatment was negligible compared with the relatively high luminosity of the bleached wool. This strongly supports the view of Wolfram et al. (1970), Ibid, that melanin disintegration does not significantly influence fiber color. It may be said that the solubilized melanin stains the fibers in the same way as a black dyestuff, Bereck and Kaplin, Ibid. A mixture of hydrogen peroxide and ammonium and/or potassium persulfate has been used successfully in the bleaching of melanin granules, as described in Corbett, J. F., *The Chemistry of Hair-care Products*, J. Soc. Dyers Colour. 92, 285–303 (1976).

There had been extensive research carried out on the selective bleaching of dark fibers using Bereck's iron mordanting technique (as described in Bereck (1985), Ibid), and the process was adopted successfully by many West German textile mills. This process consists of 3 stages, namely (i) mordanting, (ii) rinsing, and (iii) bleaching. Bereck particularly pointed out the importance of a proper choice of reducing agents in the application of ferrous salts to wool during mordanting and the thorough rinsing of the "loosely bound" ferrous and ferric ions from wool. Of the many reducing agents tested in Bereck (1985), hypophosphorous and phosphorous acids proved to be the best stabilizing agents for minimizing damage to the wool fiber. Giesen and Ziegler in Die Absorption von Eisen durch Wolle und Haar, Melliand Textilberichte, 62, 482–283 (English translation, E622–625) (1981), provide a study of the absorption of iron by wool and hair and concluded that optimum conditions for selective absorption of iron by dark fibers in wool were achieved within a pH range of 3.0–3.5, using a treatment time of 60 minutes at 80° C. Within the pH range mentioned above, the pigmented karakul wool absorbed the greatest amount of iron. At higher pH values, the absorption of iron by pigmented karakul wool diminished as the maximum uptake of iron by nonpigmented merino wool was reached at pH 4.5. Here, it would be disadvantageous to work at pH values greater than 3.5 due to an increase in iron uptake by nonpigmented wool, which may cause extensive damage and discoloration during bleaching.

Even though the aforementioned three-step process may be carefully conducted, there always remains some residual trivalent iron, which tends to give an overall undesirable reddish-brown discoloration or cast to the wool (apparently due to oxidation of ferrous to ferric ions during bleaching). Bereck et al 1982, Ibid, already have shown that selective bleaching hardly alters the natural cream color of wool. However, increasing demand for "bleached white" material led Finnimore and Bereck, Ibid, to investigate the further bleaching of selectively bleached material. Selectively bleached wool was given a second step reductive or oxidative bleaching to yield whiter material.

German Offenlegungsschrift 3,433,926 (3/27/86) to Streit et al discloses a single bath reductive and oxidative bleaching process, in which the reductive bleaching with thiourea dioxide precedes an oxidative hydrogen peroxide bleaching, whereas in the processes of the present invention the reductive bleaching is subsequent to the oxidative bleaching. Japanese patent 51-64082 (6/3/76) is drawn to a reductive bleaching process in which hydrogen peroxide and thiourea are mixed at the start of the bleaching processes (i.e., bleaching with a single mixture which contains both hydrogen peroxide and thiourea), while by contrast the instant invention utilizes separate steps of oxidative bleaching followed by reductive bleaching. It has unexpectedly and surprisingly been discovered that the process of the present invention provides greatly improved results (including, a higher Whiteness Index, lower Yellowness Index, and lower degree of damage) as compared to the results achieved by either of these two prior art processes.

It is a first object of the present invention to provide bleaching greatly superior to that of prior art processes, said bleaching providing fibers which are essentially pigment free, essentially free of iron residue (i.e. without the aforementioned undesirable reddish-brown discoloration or cast) and/or of a surprising and unexpectedly high degree of whiteness, low degree of yellowness and low degree of fiber damage.

It is a second object of the present invention to provide processes which may provide oxidative and reductive bleaching in a single bath, and thereby provide the advantages of: (a) avoiding the two or three step treatment processes normally required by conventional processes, thereby simplifying the process; (b) reducing the amount of time and energy required to provide effective bleaching; and (c) reducing the amount of equipment required to perform the bleaching.

Other objects and advantages of this invention will become readily apparent from the ensuing description.

The aforementioned objects and advantages are achieved by several processes of the instant invention. Two processes of the instant invention which employ mordanting utilize the initial steps of:

bringing both pigmented and unpigmented fibers into contact with ferrous ions under conditions which provide adsorption of the ferrous ions by the pigmented and unpigmented fibers; removing (as for example by rinsing) a portion of the ferrous ions from the pigmented and unpigmented fibers with at least a portion of the ferrous ions remaining on the pigmented fibers, and;

contacting the pigmented and unpigmented fibers with hydrogen peroxide under conditions which provide oxidative bleaching of both the pigmented and unpigmented fibers, including oxidative bleaching of the pigmented fibers by interaction of the hydrogen peroxide with ferrous ions remaining on the pigmented fibers, to produce bleached fibers in contact with unspent hydrogen peroxide. In a first process of the present invention said initial steps are followed by the steps of:

adding to the bleached fibers in contact with unspent hydrogen peroxide a material which combines with hydrogen peroxide to form a reductive bleaching agent in an amount sufficient to produce a reductive bleaching media; and maintaining the bleached fibers in the reductive bleaching media under conditions providing reductive bleaching of the bleached fibers. In a second process of the present invention said initial steps are followed by the steps of:

adding to the bleached fibers in contact with unspent hydrogen peroxide, an inactivating material in an amount at least sufficient to inactivate all of said unspent hydrogen peroxide to form an inactivated media; and subsequent to said inactivation of all said unspent hydrogen peroxide, reductively bleaching said bleached fibers by addition of a reductive bleaching agent to said inactivated media.

Additionally the present invention encompasses processes employing hydrogen peroxide and at least one persulfate containing compound, rather than the aforementioned iron-mordanting i.e.: first process which comprises, contacting fibers with hydrogen peroxide and at least one persulfate containing compound under conditions which provide oxidative bleaching of the fibers to produce bleached fibers in contact with unspent hydrogen peroxide;

adding to the bleached fibers in contact with the unspent hydrogen peroxide (from the previous step, a material which combines with hydrogen peroxide to form reductive bleaching agent (e.g. thiourea, substituted thiourea (e.g. 1,3-dimethyl-2-thiourea, 1,3-diphenyl-2-thiourea, 1,1,3,3,-tetramethyl-2-thiourea), compounds containing thiol (for example, 1-dodecanethiol, 1-octadecanethiol, thioglycolic acid, thiophenol)), in an amount sufficient to produce a reductive bleaching media; and maintaining the oxidatively bleached fibers in said reductive bleaching media under conditions providing reductive bleaching of the bleached fibers, and;

A second process of the present invention which comprises, contacting fibers with hydrogen peroxide and at least one persulfate containing compound under conditions which provide oxidative bleaching of the fibers to produce bleached fibers in contact with unspent hydrogen peroxide;

adding to the bleached fibers in contact with unspent hydrogen peroxide (from the previous step-, an inactivating material in an amount at least sufficient to inactivate all of the unspent hydrogen peroxide to form an inactivated media; and subsequent to the inactivation of all the unspent hydrogen peroxide, reductively bleaching the bleached fibers by addition of a reductive bleaching agent to the inactivated media.

The aforementioned processes unexpectedly and surprisingly provide fibers of superior whiteness, and by virtue of preventing deposition of ferric species provide fibers having surprising, highly advantageous and desirable properties e.g. fibers which are essentially pigment free as well as stain-free, essentially free of iron residue (thereby avoiding the aforementioned undesirable reddish-brown cast) and characterized by a high degree of whiteness with low degree of damage.

DETAILED DESCRIPTION OF THE INVENTION

Figure 1:
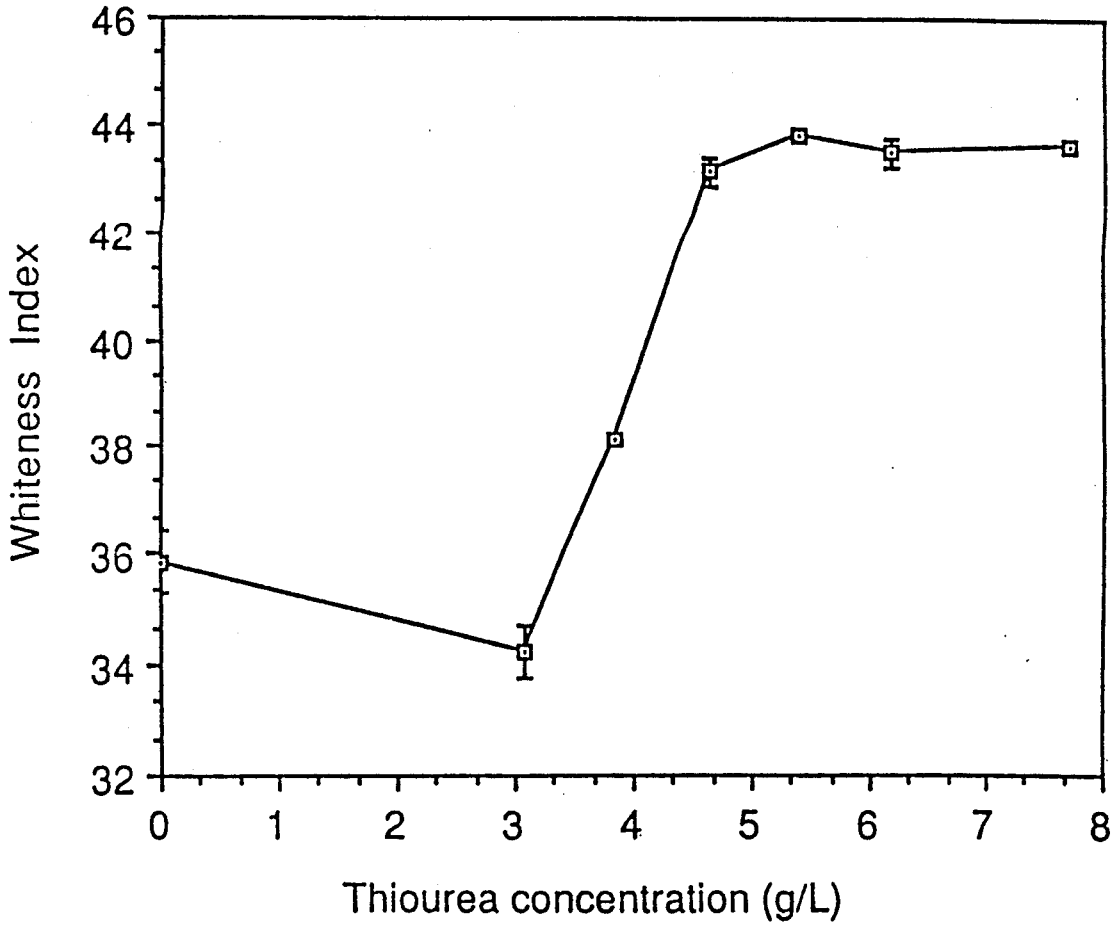
FIG. 1 is a ling graph of Whiteness Index versus thiourea concentration, for a process of the present invention with in situ formation of a reductive bleaching substance using conditions referred to in example 1 and table I.

Both of the bleaching processes of the present invention may be utilized to great advantage with any of a wide variety of fiber compositions, including animal hair fibers, plant fibers, synthetic fibers, and blends of two or more of the aforementioned (notably, fibers consisting essentially of wool, fibers consisting of cotton, and blends of wool with either materials). Said fibers may be in any suitable form which permits bleaching, including: loose fibers, yarns (twisted, woven, wrapped, etc.), fabric (e.g. woven, matted, felted), etc. Also, the fibers may be pigmented or unpigmented, and/or stained (e.g. urine-stained). Contamination of wool by urine-stained and black-pigmented fibers is viewed as a major problem of American wool. It is also a great advantage of the present invention that the processes may be carried out over a wide range of temperatures, e.g. 20° C. to 100° C. Both of the bleaching processes of the present invention permit either: (1) all steps to be carried out batch-wise in a single bath; or (2) all steps to be carried out continuously using a continuous pad system ("padding" is a process well known in the art, and is for example defined on page 109 of *Textile Terms and Definitions*, Fifth Edition, published by Textile Institute, August 1963). Either of the processes of the present invention may produce novel and highly advantageous fibers having unexpectedly superior properties, such as a degree of whiteness as measured by ASTM E-313 of at least about 43 degree of damage indicated by an alkali solubility of 30% or less as measured by IWTO-4-60, preferably said degree of whiteness being at least 44 with a said solubility of 25% or less, and more preferably a said degree of whiteness of at least about 46.

When the aforementioned first process of the present invention is carried out employing thiourea as the material which combines with hydrogen peroxide to form a reductive bleaching agent, it is preferred to: add the thiourea in a stoichiometric ratio to the unspent hydrogen peroxide of at least about 1 to 4 , i.e. at least one mole of thiourea for each 4 moles of unspent hydrogen peroxide (more preferably in a said ratio of at least about 2 to 4, i.e. at least about 2 moles of thiourea for each 4 moles of unspent hydrogen peroxide, and most preferably in a said ratio of about 2 to 4 i.e. about 2 moles of thiourea for each 4 moles of unspent hydrogen. peroxide), and; adjust the reductive bleaching media to a pH of about 6 to about 9, more preferably about 7 to about 8. The addition of thiourea to hydrogen peroxide creates a reducing medium in situ. This will not only enhance bleaching (i.e. further whiten the fibers), but also reduces any ferric ions that may have been oxidized by hydrogen peroxide to ferrous ions which have a much lower affinity for wool than ferric ions and therefore may easily be washed away. Also, in regard to said first process, it is preferred to carry out the bleaching of fibers in the reductive bleaching media for a time period of from about 25 to about 35 minutes.

In carrying out the aforementioned second process of the present invention, it is preferred to: utilize as the inactivating material a material selected from the group consisting of:

(1) catalysts which catalyze decomposition of hydrogen peroxide, such as transition metals preferably used at a pH of from about 6 to about 10 (e.g. if necessary a suitable chemical is added to the oxidatively bleached fibers in contact with unspent hydrogen peroxide, in order to bring the pH into the range of from about 6 to about 10). Optionally, after the transition metal(s) have completed deactivation of the unspent hydrogen peroxide, a chelating agent may be added in order to chelate excess transition metal ions (if any) prior to the reductive bleaching;

(2 ) enzymes which decompose hydrogen peroxide; preferably the pH of the bleached fibers in contact with unspent hydrogen peroxide is adjusted to be from about 3 to about 10 prior to adding the enzyme. For example, suitable enzymes include catalase (which preferably is used at a pH of from about 5 to about 8.5) and enzymes referred to in chapter 8 of *Hydrogen Peroxide*, W. C. Schumb et al, editors, published by Reinhold Pub. Corp., N.Y., 1955;

(3) materials which react with hydrogen peroxide to render the hydrogen peroxide inactive, such as cerium (which may be provided in chemical combination with other materials, but which upon addition to the oxidatively bleached fiber and unspent hydrogen peroxide makes cerium available for reaction with hydrogen peroxide) or quinones.

While any suitable reductive bleaching agent may be utilized in said second process, it is preferred to utilize as the reductive bleaching agent either thiourea dioxide or sodium hydroxymethanesulfinate.

It is preferred, in carrying out the present invention, to carry out the step of bringing the pigmented and unpigmented fibers into contact with ferrous ion in the presence of an iron reducing agent. Examples of such agents which may be utilized in the present invention include hypophosphorous acid, phosphorous acid and sodium bisulfite.

Persulfate containing compounds useable in the present invention include salts of persulfate. Examples of specific persulfate containing compounds useable in the present invention include, ammonium persulfate, sodium persulfate and potassium persulfate.

EXAMPLES

The following examples are intended only to further illustrate the invention and are not intended to limit the scope of the invention which is defined by the claims.

In the following examples, bleaching of wool fabric was performed using an Ahiba Texomat (Ahiba Inc., Charlotte, N.C.) laboratory dyeing apparatus. Oxidation potential was monitored on a voltmeter using a Corning Platinum Redox Combination electrode (Fisher Scientific Co., Springfield, N.J.); pH was monitored on an E & K pH meter (E & K Scientific product, Saratoga, Calif.) using a combination glass electrode (Cole-Parmer International, Chicago, Ill.). All bleaching treatments were carried out at a liquor to wool ratio of 30 milliliters liquor : 1 gram of fabric. Wool samples (10 g) were bleached in various bleach bath compositions and conditions.

Whiteness (ASTM; E-313) and Yellowness (ASTM; D-1925) Indices were measured with a Colorgard System 1000 tristimulus colorimeter (Pacific Scientific Co., Silver Spring, Md.). Sample illumination was by a quartz-halogen lamp at color temperature of 2854 degrees Kelvin with 360° circumferential illumination (CIE Source C, 1931 Standard Observer Illuminant) geometry that is 45° from the sample's normal direction, sample viewing being at 0°. The equations used in the Colorgard System for the calculations of Whiteness and Yellowness Indices are:

$$WI = 3.387Z - 3Y$$
$$YI = [100(1.277X - 1.06Z)]/Y$$

where X, Y and Z are the measured tristimulus values; WI is the WHiteness Index, and YI is the Yellowness Index. The extent of degradation of the wool caused by bleaching was determined by measuring the loss in weight of the sample after immersion in 0.1 M sodium hydroxide for 1 hour at 65±0.5° C. [I.W.T.O. Technical Committee Report, 1960, IWTO-4-60(E)]. Wet tensile strength measurements of wool flannel, bleached and treated under various conditions were carried out according to the standard method as set forth in ASTM , 1981 Book of ASTM standards, Am. Soc. for Testing and Materials: Wool flannel fabric was cut into ten equal size strips of length 140 mm and width 13 mm, 5 oriented along the warp axis (18 yarns) and the other 5 along the weft axis (14 yarns). These samples were then soaked for 24 hours in an aqueous solution containing Triton X-100 (0.5 g/L). An Instron tensile testing machine (Instron Crop., Canton, Mass.) of gauge length 90 mm was used for the measurements of breaking load and elongation. The wetted-out samples were secured between the clamps and a constant rate of load was applied along the warp or weft directions until the fabric was broken.

A. Oxidative hydrogen peroxide bleaching followed by thiourea

One aspect of the present invention relates to the formation of a reductive substance in situ when thiourea is added to an oxidative hydrogen peroxide bleach bath. When using thiourea, a strong reductive substance is preferably formed under approximately neutral or slightly alkaline conditions (e.g. pH of about 6 to about 9, preferably a pH of from about 7 to about 8). The optimum stoichiometric ratio of thiourea to hydrogen peroxide was found to be about 2 to 4. An exact amount of thiourea therefore may be calculated based on the amount of unspent hydrogen peroxide remaining after a bleaching process, and that amount of thiourea may be added to the bleach bath for maximum efficiency. In the examples a marked drop in pH (pH=2 to 3) and an increase in temperature (by 5-7° C.) of solution were observed along with the appearance of incipient turbidity. The pH of the solution was then adjusted to a pH of from about 7 to about 8, at which point the oxidation potential of the solution changed markedly from a positive to a very negative value, indicative of the complete consumption of hydrogen peroxide.

EXAMPLE 1

Bleaching experiments were done in stirred bleaching vessels immersed in a stirred thermostatic bath. The substrate was a wool flannel fabric (20.60–26.39 microns in diameter, 233 g/m$^2$) with black hair contamination and urine-stained wool, kindly supplied by Forstmann and Co., Inc., Dublin, Ga. Wool flannel fabric was bleached in the alkaline hydrogen peroxide bleach bath for 1 hour at 60° C. This was then followed by addition of thiourea and the necessary pH adjustment to attain a reductive substance in situ for the reductive bleaching part of the process. The reductive bleaching was carried out for 25 minutes at the same temperature. The bleaching conditions and the results are shown in Table I and depicted graphically in FIG. 1.

| Alkaline bleach bath composition | |
|---|---|
| Hydrogen peroxide (30% w/w) | 20.0 mL/L of liquor |
| Tetrasodium pyrophosphate decahydrate | 10.0 g/L of liquor |
| Triton X-100 | 1.0 g/L of liquor |
| Initial pH of bleach bath | 9.4 |
| pH after oxidative bleaching for 1 hr at 60° C. | 8.3 |
| Weight of wool flannel fabric | 10 g |
| Liquor to wool ratio | 30 milliliters of liquor: 1 gram of wool |

Sufficient thiourea should be added to make certain that a reductive bleaching media is produced. Above a certain thiourea concentration, not further improvement of whiteness of wool flannel fabric is observed. It is also apparent from the results in Table I that the pH adjustment to 7–8 may be very advantageous for attaining a high negative oxidation potential and an improvement in the whiteness of wool flannel fabric. The pH may be adjusted to provide a suitable reduction potential so that

TABLE I

The effect of thiourea concentration on the oxidative/reductive bleaching of wool flannel.[a]

| Thiourea (g/L) | Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) | Reduction potential (mV)[f] |
|---|---|---|---|---|---|---|---|---|
| Unbleached | 11.42 ± 0.45 | 23.71 ± 0.20 | 11.60 ± 0.43 | 35.62 ± 1.41 | 56.64 ± 1.92 | 24.72 ± 1.26 | 60.57 ± 2.79 | — |
| —[g] | 35.85 ± 0.54 | 12.38 ± 0.17 | 22.43 ± 1.09 | 35.18 ± 2.58 | 55.32 ± 2.44 | 27.87 ± 0.83 | 55.51 ± 1.72 | +201 |
| 3.07 | 34.24 ± 0.48 | 13.16 ± 0.26 | 24.48 ± 0.49 | — | — | — | — | +226 |
| 3.85 | 38.09 ± 0.07 | 11.49 ± 0.03 | — | — | — | — | — | −170 |
| 4.61 | 43.15 ± 0.28 | 9.55 ± 0.03 | 22.14 ± 0.69 | — | — | — | — | −663 |
| 5.38 | 43.83 ± 0.09 | 9.23 ± 0.04 | 23.53 ± 0.37 | 32.43 ± 1.06 | 55.13 ± 1.90 | 22.99 ± 0.63 | 51.25 ± 1.88 | −698 |
| 6.15 | 43.52 ± 0.26 | 9.17 ± 0.16 | 24.00 ± 0.24 | — | — | — | — | −692 |
| 7.69 | 43.62 ± 0.05 | 9.23 ± 0.08 | 24.44 ± 0.22 | 32.74 ± 1.73 | 53.58 ± 2.37 | 22.39 ± 1.59 | 50.48 ± 2.80 | −680 |
| 5.38[h] | 31.84 ± 0.40 | 14.51 ± 0.22 | — | 43.30 ± 0.78 | 57.46 ± 1.72 | 27.82 ± 0.58 | 53.26 ± 0.99 | −14 |
| 5.38[i] | 37.14 ± 0.42 | 12.11 ± 0.14 | — | — | — | — | — | −242 |

[a]Alkaline hydrogen peroxide bleaching, 60° C., 1 hr, followed by thiourea addition, pH adjustment with NaOH to pH 7.4–7.6 unless indicated, and continued bleaching, 60° C., 25 min.
[b]As per ASTM E-313; mean value ± standard deviation of 3 samples, each having 8 measurements.
[c]As per ASTM D-1925; mean value ± standard deviation of 3 samples, each having 8 measurements.
[d]As per IWTO-4-60; mean value ± standard deviation of 3 samples.
[e]As per ASTM D-1682-64; mean value ± standard deviation of 5 determination.
[f]Measured immediately after thiourea addition and pH adjustment.
[g]I.e., alkaline hydrogen peroxide bleaching for 1 hr 25 min with no pH adjustment at 1 hr.
[h]pH of the solution is not adjusted after the addition of thiourea (pH = 3.6).
[i]Solution was buffered (pH = 6.8) before thiourea addition so that the reaction is carried out under neutral conditions.

Below a certain thiourea concentration (FIG. 1), no improvement in whiteness of wool flannel fabric is observed, this being due to the fact that under these conditions, a reductive substance is not formed since there is not sufficient thiourea to react with all the residual hydrogen peroxide.

an improvement in whiteness of the wool flannel fabric is achieved.

EXAMPLE 2

Figure 2:
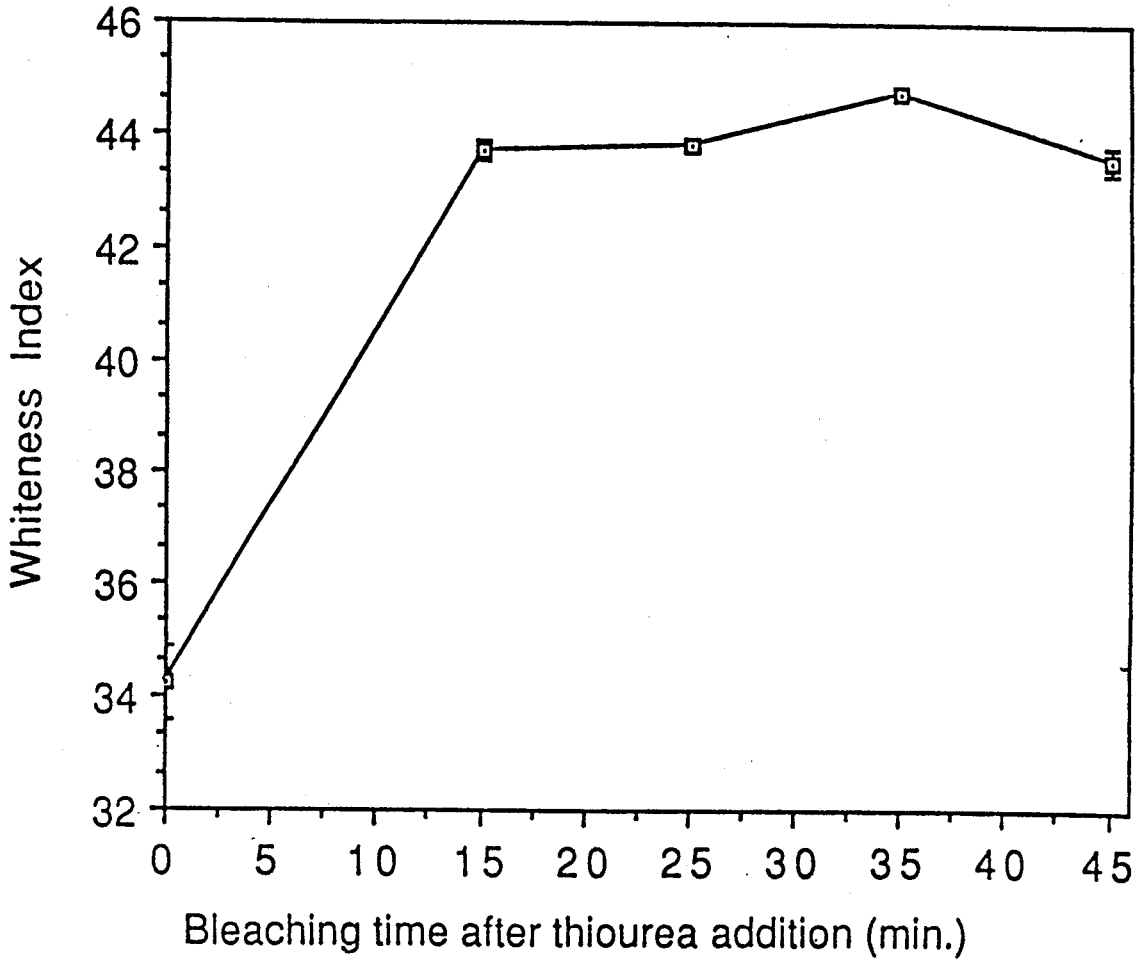
FIG. 2 is a line graph of Whiteness Index versus bleaching time after thiourea addition, for a process of the present invention (using conditions as described in example 2 and table II), showing the effect of varying bleaching time.

The bleaching solution composition and conditions were the same as those of Example 1 except that bleaching time after thiourea addition following alkaline hydrogen peroxide bleaching was varied. The results are shown in Table II and depicted graphically in FIG. 2.

TABLE II

The effect of thiourea bleaching time on the oxidative/reductive bleaching of wool flannel.[a]

| Bleaching time after thiourea addition (min.) | Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) |
|---|---|---|---|---|---|---|---|
| —[f] | 34.23 ± 0.66 | 13.15 ± 0.31 | 19.04 ± 0.33 | 35.32 ± 1.02 | 55.88 ± 1.70 | 28.25 ± 0.75 | 56.51 ± 1.03 |
| 15 | 43.69 ± 0.18 | 9.18 ± 0.07 | 22.05 ± 0.26 | — | — | — | — |
| 25 | 43.83 ± 0.09 | 9.23 ± 0.04 | 23.53 ± 0.37 | 32.43 ± 1.06 | 55.13 ± 1.90 | 22.99 ± 0.63 | 51.25 ± 1.88 |
| 35 | 44.75 ± 0.07 | 8.87 ± 0.07 | — | 31.17 ± 1.70 | 54.68 ± 2.82 | 21.97 ± 0.99 | 52.44 ± 1.47 |
| 45 | 43.61 ± 0.24 | 9.31 ± 0.08 | 22.54 ± 0.72 | — | — | — | — |
| 25[g] | 44.42 ± 0.05 | 9.03 ± 0.01 | 20.63 ± 0.44 | 37.36 ± 1.56 | 58.77 ± 2.17 | 26.58 ± 1.36 | 58.04 ± 1.85 |

TABLE II-continued

| Bleaching time after thiourea addition (min.) | The effect of thiourea bleaching time on the oxidative/reductive bleaching of wool flannel.[a] Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) |
|---|---|---|---|---|---|---|---|
| 25[h] | 44.63 ± 0.63 | 8.93 ± 0.25 | 21.45 ± 0.67 | 36.29 ± 2.02 | 57.49 ± 3.41 | 23.57 ± 1.44 | 54.33 ± 3.78 |

[a]As per Table I except 5.38 g/L thiourea was used for various bleaching times.
[b]As per Table I.
[c]As per Table I.
[d]As per Table I.
[e]As per Table I.
[f]I.e., alkaline hydrogen peroxide bleaching for 60 min, with neither subsequent pH adjustment nor addition of thiourea.
[g]pH was adjusted to 7.1 (6 mL of 30% w/v $Na_2CO_3$ solution) after thiourea addition.
[h]pH was adjusted to 7.4 (7.5 g $NaHCO_3$) after thiourea addition.

The results in Table II show that the bleaching time after thiourea addition is not critical in the time range studied (15–45 min.). Bleaching times of 25–35 minutes after thiourea addition are preferred. Alkali solubility values are seen to be well below the critical value of 30% as referred to in Ziegler, K. Textil-Praxis, 71, 376(1962). It is also shown in Table II that for the operating conditions of the instant example, that the pH of the bleach solution after thiourea addition may be raised to achieve a high negative oxidation potential; a pH of 7–8, obtained by weak alkalis such as sodium carbonate and bicarbonate, is as sufficient for achieving high bleaching efficiencies as higher values obtained with sodium hydroxide. The pH adjustment may be made with weak alkalis on large scale bleaching trials to avoid unwanted damage to wool that might occur from use of sodium hydroxide and uneven mixing.

EXAMPLE 3

Figure 3:
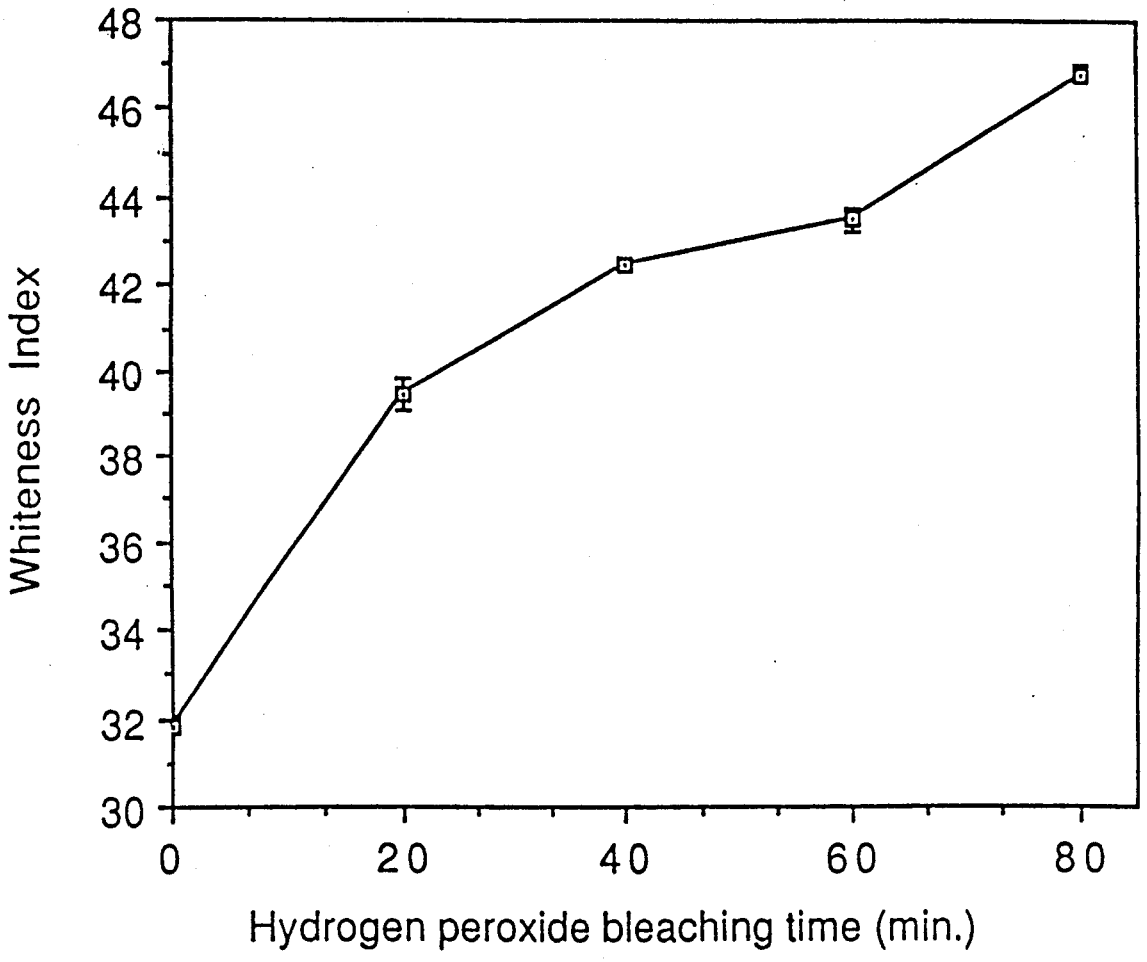
FIG. 3 is a line graph of Whiteness Index versus hydrogen peroxide bleaching time for conditions as referred to in example 3 and table III.

The bleaching solution composition and conditions were the same as those of Example 1 except the initial alkaline hydrogen peroxide bleaching time prior to thiourea addition was varied. The results, as shown in Table III and depicted graphically in FIG. 3, demonstrate that the longer the hydrogen peroxide bleaching part of the process, the whiter the bleached wool flannel fabric.

Here it must be emphasized that in the process of this example, that the wool flannel fabric to be bleached should first be given an oxidative peroxide bleaching prior to thiourea addition. This is simply demonstrated by the results given in Table III where the wool flannel fabric was not given an initial peroxide bleach. Hydrogen peroxide, thiourea and all the other additives were mixed at the start of the bleaching treatment and bleaching was allowed to proceed for 20 minutes. The importance of initial hydrogen peroxide bleaching becomes more apparent when the Whiteness Index values of wool bleached for 60 minutes (with all chemicals mixed at the start i.e. as taught by Japan 51-64082) are compared with those of wool bleached for 65 minutes (40 minutes alkaline peroxide bleach followed by thiourea addition and bleaching for 25 minutes after pH adjustment). Although in both cases a high negative oxidation potential was attained, it seems that the initial oxidative hydrogen peroxide bleaching somehow modifies wool sufficiently so that a follow-up reductive bleaching further whitens wool effectively.

EXAMPLE 4

Figure 4:
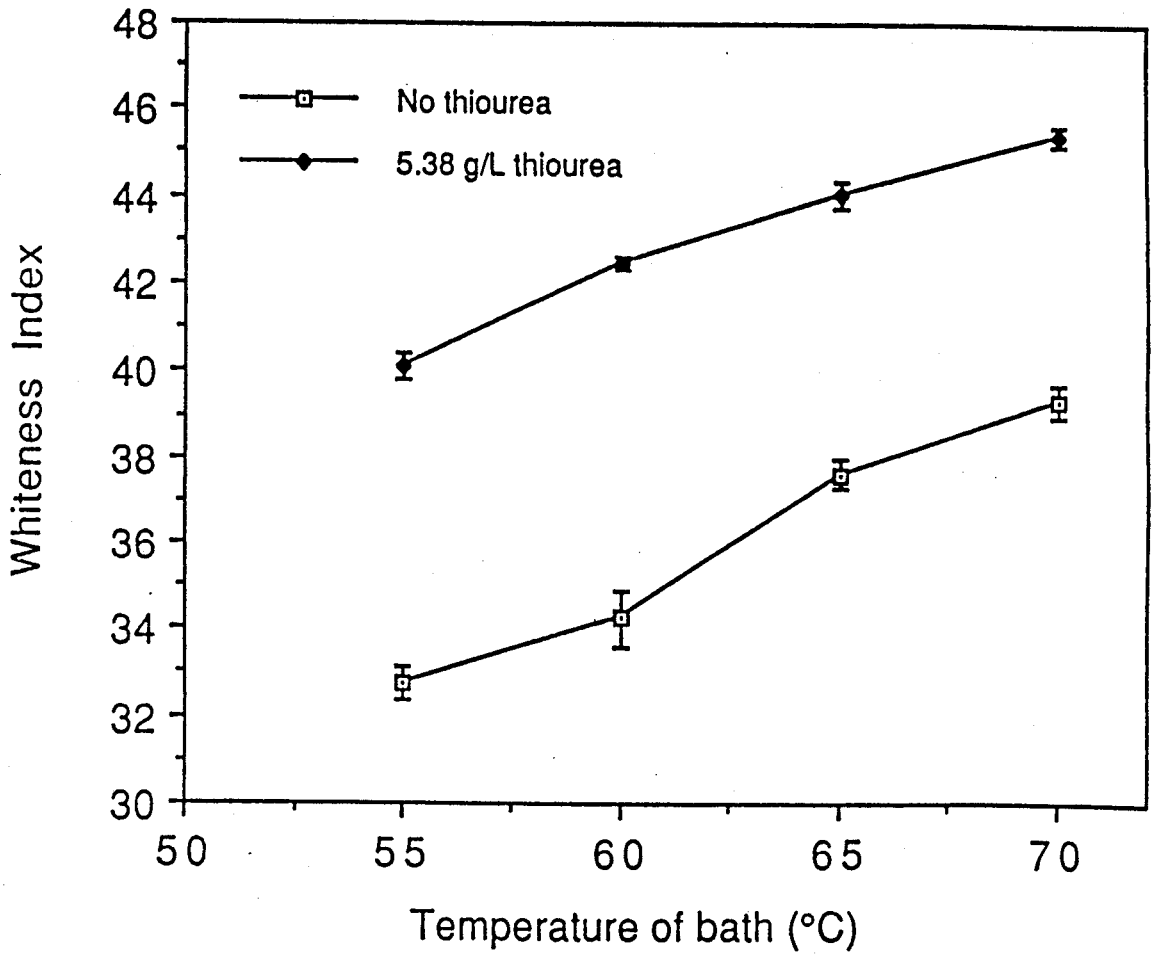
FIG. 4 is a line graph of Whiteness Index versus bath temperature: showing a comparison between conventional alkaline hydrogen peroxide bleaching and bleaching of the present invention; as referred to in example 4 and table IV.

The bleaching solution composition was the same as per Example 1. In the present example, a direct comparison of conventional alkaline hydrogen peroxide bleaching to that of the new invention (oxidative/reductive single-bath process) at different bleaching temperatures is made and the results are shown in Table IV and depicted graphically in FIG. 4.

TABLE III

| Oxidative bleaching time (min.) | The effect of varying the hydrogen peroxide bleaching time on the oxidative/reductive bleaching of wool flannel.[a] Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) |
|---|---|---|---|---|---|---|---|
| 0[f] | 31.84 ± 0.19 | 13.89 ± 0.02 | — | — | — | — | — |
| 20 | 39.43 ± 0.38 | 10.97 ± 0.16 | — | — | — | — | — |
| 40 | 42.56 ± 0.15 | 9.69 ± 0.06 | 20.12 ± 0.34 | — | — | — | — |
| 60 | 43.52 ± 0.26 | 9.38 ± 0.04 | 24.00 ± 0.24 | 32.56 ± 1.51 | 54.90 ± 2.05 | 22.60 ± 1.20 | 50.95 ± 1.30 |
| 80 | 46.82 ± 0.16 | 8.04 ± 0.04 | 24.29 ± 0.13 | 30.91 ± 1.30 | 56.31 ± 1.35 | 19.20 ± 1.28 | 48.44 ± 1.22 |

[a]As per Table I except 6.15 g/L thiourea is used.
[b]As per Table I.
[c]As per Table I.
[d]As per Table I.
[e]As per Table I.
[f]Thiourea mixed with hydrogen peroxide and pH adjusted with no prior time for oxidative bleaching.

TABLE IV

| Treatment temperature (°C.) | The effect of bleaching temperature on the oxidative/reductive bleaching of wool flannel.[a] Thiourea addition | Total time of bleaching (min.) | Whiteness Index[b] | Yellowness Index[c] | Alkali Solubility (%)[d] |
|---|---|---|---|---|---|
| 55 | No | 65 | 32.76 ± 0.39 | 13.77 ± 0.16 | — |
| 55 | Yes | 65 | 40.11 ± 0.33 | 10.73 ± 0.15 | — |
| 60 | No | 65 | 34.23 ± 0.66 | 13.15 ± 0.31 | 19.04 ± 0.33 |
| 60 | Yes | 65 | 42.46 ± 0.15 | 9.69 ± 0.06 | 20.12 ± 0.34 |
| 60[e] | Yes | 60 | 33.89 ± 0.94 | 13.51 ± 0.35 | — |

TABLE IV-continued

The effect of bleaching temperature on the oxidative/reductive bleaching of wool flannel.[a]

| Treatment temperature (°C.) | Thiourea addition | Total time of bleaching (min.) | Whiteness Index[b] | Yellowness Index[c] | Alkali Solubility (%)[d] |
|---|---|---|---|---|---|
| 65 | No | 65 | 37.63 ± 0.33 | 11.57 ± 0.13 | 28.23 ± 0.63 |
| 65 | Yes | 65 | 44.05 ± 0.31 | 9.00 ± 0.18 | 25.15 ± 0.52 |
| 70 | No | 65 | 39.36 ± 0.28 | 10.96 ± 0.11 | 32.61 ± 0.99 |
| 70 | Yes | 65 | 45.43 ± 0.23 | 8.46 ± 0.14 | 28.88 ± 0.37 |

[a]Alkaline hydrogen peroxide bleaching at different temperatures, 40 min., followed by thiourea addition (6.15 g/L; pH adjustment with NaOH to pH 7.4–7.6 only in the thiourea cases), and continued bleaching for 25 min.
[b]As per Table I.
[c]As per Table I.
[d]As per Table I.
[e]Thiourea mixed with hydrogen peroxide and pH adjusted with no prior time for oxidative bleaching.

It is noteworthy that the same level of whiteness is reached at a bleaching temperature of 55° C. with the hydrogen peroxide-thiourea bleaching system (oxidative/reductive) as at 70° C. with the hydrogen peroxide system alone. Furthermore the former process is less damaging to the wool, as evidenced by lower alkali solubilities.

EXAMPLE 5

| Acidic bleach bath composition | |
|---|---|
| Hydrogen peroxide (30% w/w) | 20.0 mL/L of liquor |
| Prestogen NB-W | 3.43 g/L of liquor |
| Triton X-100 | 1.0 g/L of liquor |
| Initial pH of bleach bath | 5.7 |
| pH after oxidative bleaching for 1 hr. at 80° C. | 5.2 |
| Weight of wool flannel fabric | 10 g |
| Liquor to wool ratio | 30 milliliter liquor: 1 gram of fabric |

Prestogen NB-W (BASF Chemicals Division, Charlotte, N.C.) is a mixture of organic acid salts in aqueous solution which activates hydrogen peroxide at mildly acid pH values by forming peroxy compounds.

In this example, we demonstrate the effectiveness of the hydrogen peroxide-thiourea system on the bleaching efficiency under acidic oxidative bleaching with hydrogen peroxide followed by thiourea. The results are shown in Table V.

TABLE V

The effect of thiourea on the oxidative/reductive bleaching of wool flannel.[a]

| Thiourea (g/L) | Total time of bleaching (min.) | Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) |
|---|---|---|---|---|---|---|---|---|
| — | 65 | 29.12 ± 0.12 | 16.24 ± 0.30 | 28.49 ± 0.30 | 37.25 ± 2.04 | 66.15 ± 2.48 | 24.39 ± 0.47 | 59.33 ± 2.00 |
| 5.38 | 65 | 42.56 ± 0.29 | 10.13 ± 0.14 | 21.72 ± 0.84 | 27.97 ± 1.83 | 56.82 ± 3.11 | 17.99 ± 1.26 | 51.88 ± 2.84 |
| — | 85 | 29.26 ± 0.33 | 16.03 ± 0.12 | — | 34.06 ± 0.31 | 63.11 ± 2.32 | 26.88 ± 1.85 | 63.75 ± 4.48 |
| 5.38 | 85 | 43.60 ± 0.21 | 9.51 ± 0.28 | — | 24.53 ± 0.83 | 53.46 ± 3.18 | 19.72 ± 0.88 | 56.22 ± 1.63 |

[a]Acidic hydrogen peroxide bleaching (as per experimental) for 40 or 60 min at 80° C., followed, when indicated, by thiourea addition, (pH adjustment with NaOH to pH 7.4–7.6), and continued bleaching at 80° C. for 25 min.
[b]As per Table I.
[c]As per Table I.
[d]As per Table I.
[e]As per Table I.

It is seen from the results that the bleaching efficiency are markedly improved with the hydrogen peroxide-thiourea system as compared to an oxidative acidic hydrogen peroxide bleaching alone. The decrease in breaking load and elongation noted in Table V for acidic oxidative/reductive bleaching is not understood, but is inconsistent with the alkali solubility results.

B. Direct addition of reductive substance to a decomposed oxidative hydrogen peroxide bleach bath It is well known that typically only a small fraction of hydrogen peroxide is consumed or decomposed during an efficient and effective bleaching process. In a typical two step, two-bath oxidative/reductive process, the goods are first bleached oxidatively using hydrogen peroxide (alkaline or acidic). They are then removed from the first bath and bleached in the second bath with a reducing agent. This process is not only costly but also time-consuming, since both baths must be heated up to a suitable temperature.

The principle behind this aspect of the present invention is that the active surplus hydrogen peroxide remaining after an oxidative bleaching treatment may be successfully decomposed with no adverse effect on the fiber or subsequent chemical treatment, thus allowing a reductive substance to be added to the bath directly. This is particularly sound for a single-bath process, since the bath is already in the temperature range suitable for subsequent reductive bleaching. There are many inorganic catalysts (such as, transition metals, e.g. iron, copper, manganese, cobalt, etc.) and enzymes that will decompose hydrogen peroxide.

A typical set of conditions would be as follows:

| | |
|---|---|
| Hydrogen peroxide (30% w/w) | 20 mL/L of liquor |
| Tetrasodium pyrophosphate decahydrate | 10 g/L of liquor |
| Triton X-100 | 1 g/L of liquor |

Wool fabric (10 g) was bleached with the above solution at a liquor to goods ratio of 30 milliliter liquor : 1 gram of wool for 60 minutes at 60° C. The pH of the bleach liquor was then adjusted to 8.8 and $CoSO_4$ (25 mg/L) was added to the bleach bath. Rapid evolution of oxygen was observed and the decomposition of hydrogen peroxide was complete within 10–15 minutes as the titration against acidified $KMnO_4$ showed. At this stage, a chelating agent such as nitrilotriacetic acid trisodium salt could be added to complex with the free Co ions and the pH of the solution could be adjusted to the desired value for the reductive bleaching part of the process.

The above is a specific set of typical conditions, but in general the conditions may be varied. It is found that hydrogen peroxide may be decomposed efficiently in the pH range 7.8–9.0 and temperature range 80–60° C. with no adverse effect on wool. Reductive bleaching is either carried out under neutral or acidic conditions. Therefore, after the decomposition of hydrogen peroxide and the pH adjustment, the temperature of the bath may be increased to the desired temperature to obtain optimum bleaching yields.

EXAMPLE 6

Figure 5:
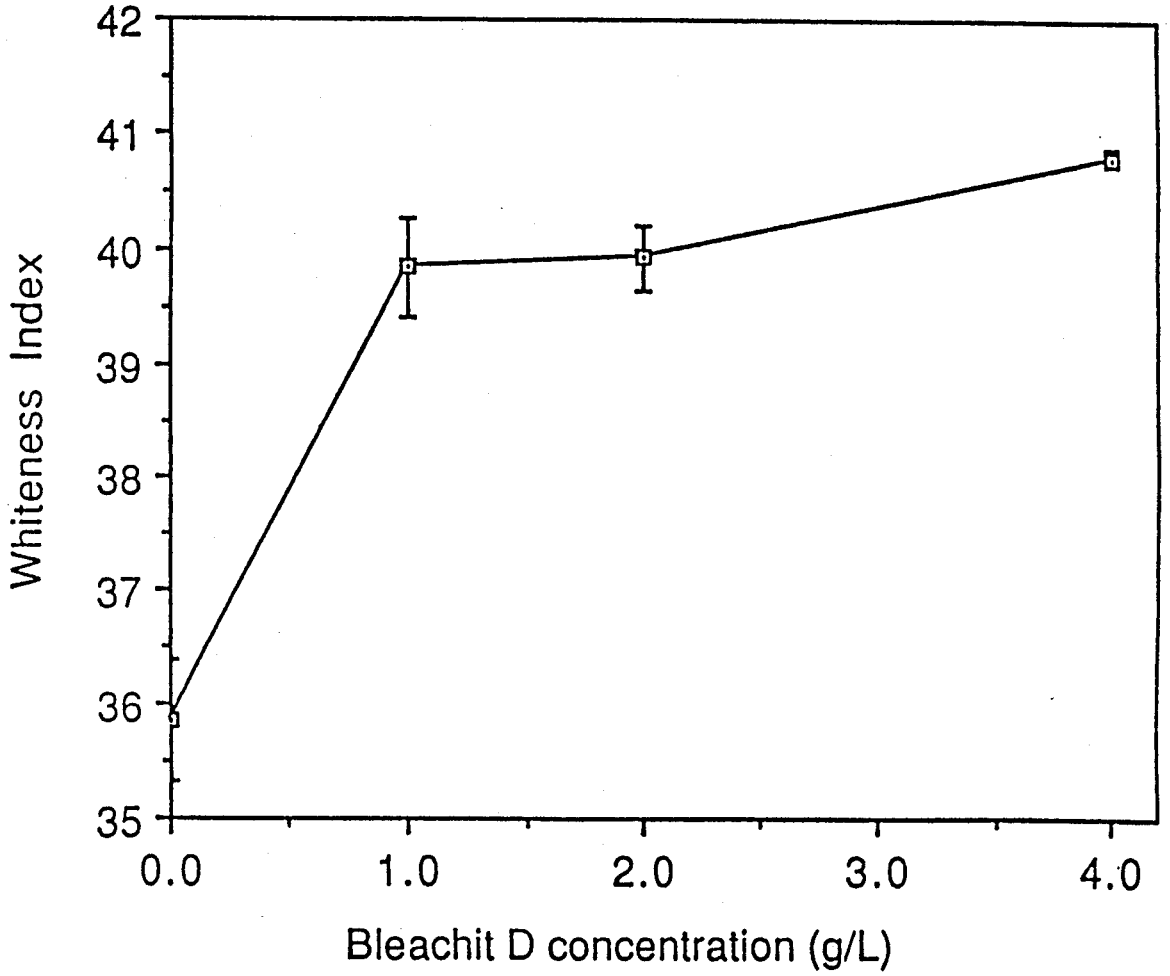
FIG. 5 is a line graph of Whiteness Index versus Bleachit D concentration ofr a process of the present invention as referred to in example 6 and table VI.
Figure 6:
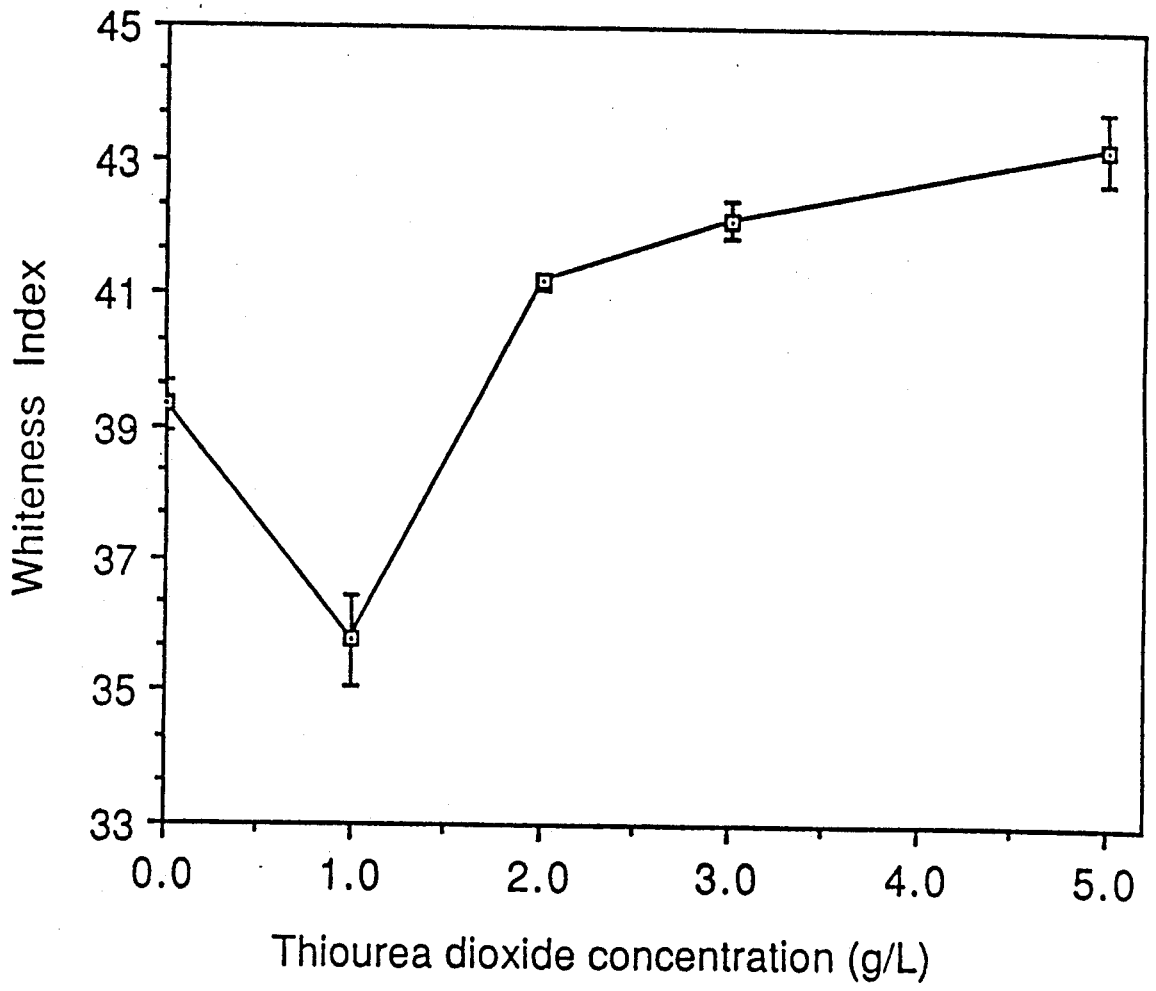
FIG. 6 is a line graph of Whiteness Index versus thiourea dioxide concentration for a process of the present invention as referred to in example 6 and table VI.

In this example the effect of reductive bleaching (sodium hydroxymethanesulfinate [Bleachit D(BASF Chemical Division, Charlotte, N.C.)] or thiourea dioxide) is demonstrated under various conditions as an aftertreatment following an oxidative alkaline hydrogen peroxide bleaching. The results of bleaching trials are shown in Table VI and depicted graphically in FIGS. 5 and 6.

TABLE VI

The effect of reductive agent aftertreatment (Bleachit D, thiourea dioxide) on the oxidative/reductive bleaching of wool flannel.[a]

| Bath temperature (°C.) | Hydrogen peroxide (mL/L) | Bleachit D (g/L) | Thiourea dioxide (g/L) | Whiteness Index[b] | Yellowness Index[c] | Alkali Solubility (%)[d] |
|---|---|---|---|---|---|---|
| 60 | 20[e] | — | — | 35.85 ± 0.54 | 12.38 ± 0.17 | 22.43 ± 1.09 |
| 60 | 20[f] | 1.0 | — | 39.84 ± 0.42 | 10.66 ± 0.21 | 24.58 ± 0.47 |
| 60 | 20[f] | 2.0 | — | 39.93 ± 0.27 | 10.58 ± 0.07 | — |
| 60 | 20[f] | 4.0 | — | 40.80 ± 0.07 | 10.60 ± 0.03 | 24.59 ± 0.69 |
| 70 | 20[e] | — | — | 39.33 ± 0.36 | 10.94 ± 0.17 | 30.73 ± 0.78 |
| 70 | 20[g] | — | 1.0 | 35.75 ± 0.66 | 12.51 ± 0.24 | 22.65 ± 0.67 |
| 70 | 20[g] | — | 2.0 | 41.21 ± 0.13 | 10.26 ± 0.19 | — |
| 70 | 20[g] | — | 3.0 | 42.14 ± 0.28 | 9.69 ± 0.08 | 22.51 ± 0.32 |
| 70 | 20[g] | — | 5.0 | 43.26 ± 0.52 | 9.24 ± 0.19 | — |

[a]As per experimental; residual hydrogen peroxide quenched using $CoSO_4$ prior to reductive bleaching.
[b]As per Table I.
[c]As per Table I.
[d]As per Table I.
[e]Alkaline hydrogen peroxide bleaching for 1 hour and 25 minutes, as per Table I, note g.
[f]As per e, but for 50 minutes, followed by peroxide decomposition with $CoSO_4$ for the next 10 minutes at pH 8.8 and finally reductive bleaching (Bleachit D, pH adjusted to 2.5) at the same temperature for 25 minutes.
[g]As per 'f' except for reductive bleaching agent (thiourea dioxide, pH adjusted to 6.5–7.0).

In the process of the instant example, the decomposition of residual hydrogen peroxide is essential; preliminary experiments showed that large amounts of reductive agents (thiourea dioxide, sodium hydroxymethanesulfinate) were needed to consume all the residual hydrogen peroxide before a high negative oxidation potential could be attain upon addition of the reductive agent. It should also be noted that thiourea dioxide, unlike sodium hydroxymethanesulfinate, does not produce a high negative oxidation potential under acidic conditions; therefore, with thiourea dioxide it is preferred to utilize a pH of about 6.5–7.0. For reasons of economy it is preferred that all residual hydrogen peroxide after oxidative bleaching be completely decomposed so that an addition of only a relatively small amount of reductive substance creates the reduction potential that is needed for the latter part of the process.

EXAMPLE 7

COMPARATIVE EXAMPLE

The purpose of this example is to show the increased effectiveness of the present invention as compared to the processes of German Patent DE 3433926 A1 (3/27/86) and Japanese Patent JP 51-64082 (6/3/76). The German patent discloses a single-bath process whereby a reductive bleaching with thiourea dioxide precedes an oxidative hydrogen peroxide bleaching. In that patent, two processes--one with and one without thiourea dioxide--were compared and it was concluded that the process with thiourea dioxide was favorable to the one without. The optimum bleaching conditions were said to be a reductive bleaching with a buffer mixture (pH=7.8, 4 g/L) containing thiourea dioxide (0.36 g/L) for 20 minutes at 80° C. followed by a direct addition of hydrogen peroxide (20 mL/L of 35% w/w solution) and further bleaching for 60 minutes at the same temperature. The Japanese patent mentions a process whereby thiourea and hydrogen peroxide are mixed at the start of the bleaching process (i.e., no prior oxidative bleaching) and there is no prescribed pH adjustment. Optimum bleaching conditions were said to be 2.91 g/L hydrogen peroxide (30% w/w) and 2.0 g/L thiourea at 95° C. for 20 minutes.

All the above processes were repeated in the exact manner outlined in the patents and the results along with those of our invention are shown in Table VII.

TABLE VII

Comparison of different bleaching processes.

| Process Type[a] | Treatment temperature (°C.) | Hydrogen peroxide (g/L) | Thiourea (g/L) | Thiourea dioxide (g/L) | Bleachit D (g/L) | Whiteness Index[b] | Yellowness Index[c] | Alkali solubility (%)[d] |
|---|---|---|---|---|---|---|---|---|
| A | 60 | 20 | 5.38 | — | — | 43.83 ± 0.09 | 9.23 ± 0.04 | 23.53 ± 0.37 |
| B | 80 | 20 | 5.38 | — | — | 42.56 ± 0.29 | 9.51 ± 0.28 | 21.72 ± 0.84 |
| C | 80 | 20 | — | 0.36 | — | 35.31 ± 0.07 | 13.29 ± 0.02 | 27.40 ± 0.64 |
| C | 80 | 20 | — | — | — | 32.59 ± 0.21 | 14.36 ± 0.07 | — |
| D | 95 | 2.91 | 2.0 | — | — | 20.33 ± 0.50 | 18.87 ± 0.15 | — |
| E | 60 | 20 | — | — | 4.0 | 40.80 ± 0.07 | 10.60 ± 0.03 | 24.59 ± 0.69 |

TABLE VII-continued

| Process Type[a] | Treatment temperature (°C.) | Hydrogen peroxide (g/L) | Comparison of different bleaching processes. Thiourea (g/L) | Thiourea dioxide (g/L) | Bleachit D (g/L) | Whiteness Index[b] | Yellowness Index[c] | Alkali solubility (%)[d] |
|---|---|---|---|---|---|---|---|---|
| F | 70 | 20 | — | 5.0 | — | 43.26 ± 0.52 | 9.24 ± 0.19 | — |

[a]A (Our Process): Alkaline hydrogen peroxide bleaching followed by thiourea, as per Table I, note a; B (Our Process): Acidic hydrogen peroxide bleaching followed by thiourea, as per Table V, note a; C (German Patent): Reductive bleaching with thiourea dioxide at pH 7.8 for 25 min, followed by hydrogen peroxide bleaching for 60 min,; D (Japanese Patent): Hydrogen peroxide and thiourea mixed at start of bleaching process with no pH adjustment; E (Our Process): As per Table VI, note f; F (Our Process): As per Table VI, note g.
[b]As per Table I.
[c]As per Table I.
[d]As per Table I.

It is clearly seen that the present invention processes (A, B, E, F) give more effective bleaching (i.e. higher Whiteness Index, lower Yellowness Index and lower alkali solubility) than either of the other processes (C or D). Process type C (Table VII; reductive/oxidative) with thiourea dioxide is a near reverse of the present invention processes A, B, E and F (oxidative/reductive). One would therefore expect similar results. The differences that were observed must be a function of the process sequence, since high negative oxidation potentials were observed in all these processes. One may therefore conclude from this that in a single-bath bleaching process, an oxidative hydrogen peroxide bleaching must be carried out first, and only then followed by a reductive bleach.

C. Initial Treatment with ferrous ions followed by bleaching in accordance with the aforementioned processes The wool used was a flannel fabric (Whiteness Index=−4.40, Yellowness Index=32.70, 507 g/m$^2$) heavily contaminated with black hair and urine-stained wool, kindly supplied by Forstmann and Co., Inc., Dublin, Ga. The hydrogen peroxide used was a 30% (w/w) aqueous solution. The non-ionic wetting agent Triton X-100 was provided by Rohm and Haas Co., Philadelphia, Pa. Tetrasodium pyrophosphate decahydrate was obtained from Aldrich Chemicals Co., Inc., Milwaukee, Wis. All other chemicals used were of A.C.S. grade. Mordanting and bleaching of wool fabric were performed using an Ahiba Texomat (ahiba Inc., Charlotte, N.C.) laboratory dyeing apparatus. All laboratory mordanting and bleaching trials were carried out at a liquor/wool ratio of 30 milliliters to 1 gram of fabric.

(1) Mordanting:

Wool flannel fabric (10.0 grams) was introduced into the mordant bath at 40° C. and the temperature was then raised to 80° C. over a period of 20 minutes. Mordanting was further carried out at this temperature for 1 hour.

Mordant Solution $FeSO_4 \cdot 7H_2O$ (10.0 grams/liter)

Reducing Agent

Hypophosphorous acid (0.2 gram/liter) or
Sodium bisulfite (2.0 gram/liter)
Triton X-100 (1.0 gram/liter)
pH (initial)=2.87
pH (after mordanting)=3.45

(2) Rinsing:

The flannel was then removed and thoroughly rinsed 4 times in changes of deionized water at 80° C., each rinsing being for 5 minutes under acidic conditions (pH=2.0–3.5). The flannel was then air-dried.

(3) Bleaching:

Bleaching was carried out under alkaline conditions for a specified time and temperature in the bleach bath of composition as listed below.

Bleach Solution

Hydrogen peroxide (30% w/w; 20.0 ml/liter)
Tetrasodium pyrophosphate decahydrate (10.0 grams/liter)
Triton X-100 (1.0 g/l)
Aqueous ammonia, if necessary, to pH 8.0–8.5
pH (initial)=9.37
pH (final)=8.2–8.5

Using the aforementioned methods and materials the following processes were carried out:

Process A—Alkaline hydrogen peroxide bleaching for 90 minutes at 60° with no prior mordanting;

Process B—As per A except thiourea (5.83 grams/liter) was added, pH adjusted to 7–8 and bleaching continued over the last 30 minutes;

Process C—Mordanting using ferrous sulfate (10.0 grams/liter) and hypophosphorous acid (0.20 grams/liter) for 1 hour at 80° C., followed by thorough rinsing with deionized water at 80° C. and finally bleaching with alkaline hydrogen peroxide for 90 minutes at 60° C.;

Process D—As per C except thiourea (5.83 grams/liter) was added, pH adjusted to 7–8 and bleaching continued in the last 30 minutes;

Process E—Mordanting using ferrous sulfate (10.0 grams/liter) and sodium bisulfite (2.0 grams/liter) for 1 hour at 80° C., followed by thorough rinsing with deionized water at 80° C. and finally bleaching using alkaline hydrogen peroxide for 90 minutes at 60° C.;

Process F—As per E except thiourea (5.83 grams/liter) was added, pH adjusted to 7–8 and bleaching continued over the last 30 minutes.

Results were as shown in the following Table.

TABLE VIII

| PROCESS | Whiteness Index[a] | Yellowness Index[b] | Alkali Solubility (%)[c] |
|---|---|---|---|
| A: $H_2O_2$ | 15.09 ± 0.20 | 23.47 ± 0.07 | 21.50 ± 0.63 |
| B: A, then thiourea | 19.33 ± 0.32 | 21.28 ± 0.11 | 18.21 ± 0.43 |
| C: $Fe^{2+}$, $H_3PO_2$, then A | 14.47 ± 0.34 | 23.97 ± 0.13 | 22.24 ± 0.21 |
| D: $Fe^{2+}$, $H_3PO_2$, then B | 19.49 ± 0.04 | 21.43 ± 0.03 | 20.13 ± 0.95 |
| E: $Fe^{2+}$, $NaHSO_3$, then A | 21.73 ± 0.24 | 22.72 ± 0.01 | 26.95 ± 0.82 |
| F: $Fe^{2+}$, $NaHSO_3$, then B | 26.14 ± 0.31 | 20.55 ± 0.12 | 23.11 ± 0.09 |

[a]As per ASTM E-313; mean value of 3 samples ± standard deviation, each sample having 8 measurements.
[b]As per ASTM D-1925; means value of 3 samples ± standard deviation, each sample having 8 measurements.
[c]As per IWTO-4-60; mean value of 3 samples ± standard deviation.

Figure 7:
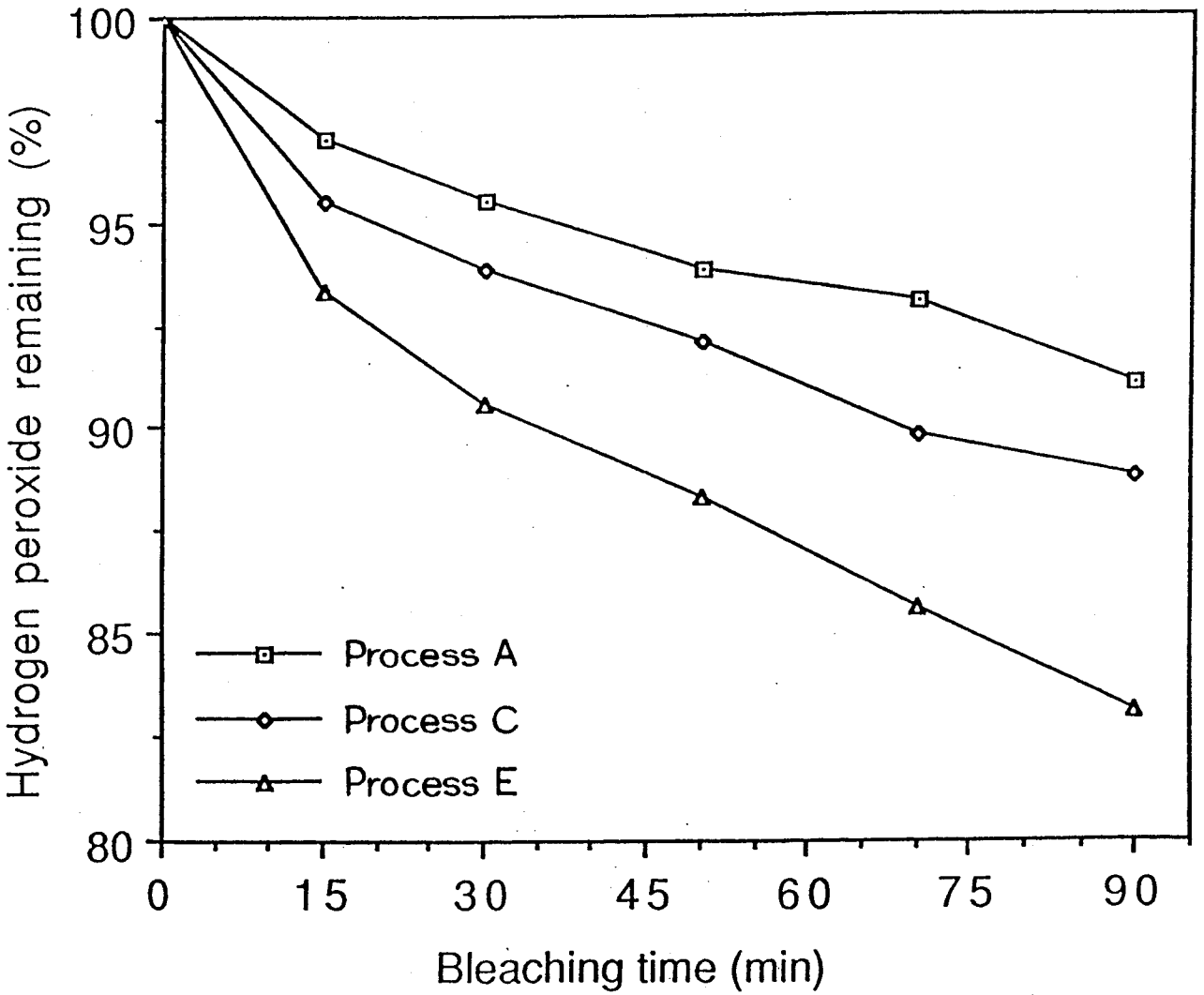
FIG. 7 is a graph of hydrogen peroxide remaining versus bleaching time in minutes, showing decomposition of hydrogen peroxide in the bleach bath during bleaching of wool.

It is seen from Table VIII that the differences in Whiteness and Yellowness Indices of the samples treated by processes A and C are very small, even though one would have expected to obtain a whiter sample with the mordanted wool (treatment process C). There are two possible explanations to account for this. First, the samples used in the investigations are urine-stained wool with black hair contamination. Since the conditions were selected to yield optimum selective bleaching of black hair, the bleaching of the non-pigmented areas-the majority of the wool fibers-was not expected to be higher in one case over the other. The color indices are not expected to be sensitive to changes in the relatively few pigmented fibers. The human eye, however, is more discriminatory; close examination reveals that the black hairs in the case of the bleached mordanted wool have turned into a pale light brown shade that blend well with the background color of wool. In the case of the bleached non-mordanted wool, the situation is quite different; the black hairs were only negligibly lightened and are still readily detected by the eye. Second, ferrous ions, even if present in only a small amount after the rinsing step, may cause a red-brown discoloration to the overall appearance of wool as a result of oxidation of ferrous species by hydrogen peroxide during the bleaching stage. This may well account for the small differences in the Whiteness and Yellowness Indices of the mordanted vs. non-mordanted bleached wool (process C vs. A).

the effect of different reducing agents during mordanting on the bleaching efficiency of wool was also investigated, i.e. a comparison of hypophosphorous acid to sodium bisulfite (Table VIII; processes C and E, respectively). Both compounds were found to be effective reducing agents in the application of ferrous ions onto wool and thus effective for selectively bleaching black hair. When the results of the bleaching trials are closely compared, it is easily seen that bleached wool mordanted in the presence of sodium bisulfite has a higher Whiteness Index but also a higher Yellowness Index than the wool mordanted in the presence of hypophosphorous acid. This is due to the fact that the wool mordanted in the presence of sodium bisulfite absorbed more iron (much darker color appearance after mordanting) than that mordanted in the presence of hypophosphorous acid. The excess iron will lead to greater reaction of hydrogen peroxide and hence enable more efficient bleaching. The bleached wool sample, however, is yellower. Measurements of hydrogen peroxide decomposition during bleaching in the presence of wool samples that had undergone different treatments are shown in FIG. 7. Enhanced decomposition of hydrogen peroxide is seen using wool that was mordanted in the presence of sodium bisulfite.

Absorption of excessive amounts of iron during mordanting and retainment after thorough rinsing may cause excessive damage to wool during bleaching. This is reflected in the alkali solubility results that are presented in Table VIII. Note the higher alkali solubility in the case of iron and sodium bisulfite treated wool. We infer from our data that bisulfite is not as good a reducing agent as hypophosphorous acid for stabilizing ferrous species on wool, that excessive amounts of ferric ion form on the wool (and are even visible as a reddish-brown discoloration), and that subsequent rinsing followed by treatment with hydrogen peroxide leads to excessive decomposition of peroxide and limited damage to the wool fiber despite good whiteness.

The results of the bleaching trials in combination with thiourea are also presented in Table VIII. IT is clearly seen from the results in Table VIII that any of the bleaching trials that are mentioned above, when combined with thiourea and appropriate pH adjustment, yield much superior bleaching. This is very apparent when treatment processes A and B, C and D, and E and F are compared. The increase in Whiteness Index values and the decrease in Yellowness Index values are due to further bleaching of heavily yellow stained wool and the substantial lightening of the background discoloration caused by ferric species.

The effect of various agents such as oxalic acid, sodium oxalate, and EDTA-disodium salt on the lightening of background discoloration on wool were investigated and the results are presented in the following Table.

TABLE IX[a]

| After Treatment (conc., grams/liter) | Whiteness Index | Yellowness Index | Alkali Solubility |
|---|---|---|---|
| None | 20.89 ± 0.03 | 23.06 ± 0.13 | 20.65 ± 0.54 |
| Oxalic acid (3.0) | 17.09 ± 0.84 | 24.99 ± 0.32 | 19.63 ± 1.36 |
| Sodium oxalate (3.0) | 19.79 ± 0.24 | 23.60 ± 0.09 | — |
| EDTA, $Na_2$ salt (3.0) | 19.34 ± 0.04 | 23.93 ± 0.07 | — |
| Thiourea (5.83) pH 7–8 | 25.47 ± 0.32 | 20.62 ± 0.18 | — |
| Thiourea[b] (5.83) pH 7–8 | 27.78 ± 0.59 | 19.70 ± 0.28 | 16.44 ± 0.25 |

[a]Mordanting using ferrous sulfate (10.0 grams/liter) and hypophosphorous acid (0.2 grams/liter) for 1 hour at 80° C., followed by thorough rinsing with deionized water at 80° C. and finally bleaching using alkaline hydrogen peroxide for 65 minutes at 65° C. Aftertreatment is done, where stated, in the last 5 minutes of the bleaching stage.
[b]As per footnote a except alkaline hydrogen peroxide bleaching is carried out for 40 minutes at 65° C., followed by thiourea addition, pH adjustment to 7–8 and further bleaching for 25 minutes.

Whiteness index, yellowness index and alkali solubility were as per Table VIII. These results, in turn, were compared to those of no aftertreatment and thiourea treatment. It was thought that the above mentioned agents would chelate with and solubilize the iron present on wool after the bleaching stage and hence lighten the background discoloration. However, no after-treatments except thiourea gave any improvement in the lightening of wool as compared to the wool not given an after-treatment. The reaction of thiourea with the residual hydrogen peroxide after the bleaching stage and the necessary pH adjustment create a highly reductive medium that reduces any ferric species that may be present on wool to the ferrous form, which is easily washed away due to its much smaller affinity to unpigmented wool. Prolonged treatment with thiourea (25 minutes as compared to 5 minutes) yielded a whiter and less yellow sample due to further bleaching of the heavily yellow-stained wool. The alkali solubilities in all cases are within acceptable limits.

D. Oxidative Bleaching Using Hydrogen Peroxide/Persulfate Followed By the Aforementioned Processes Of Reductive Bleaching In The Same Bath

EXAMPLE 8

Bleaching experiments were done in stirred bleaching vessels immersed in a stirred thermostatic bath. The substrate was a wool flannel fabric (507/g/$M^2$) heavily contaminated with black hair and urine-stained wool, kindly supplied by Forstmann and Co., Inc., Dublin, Ga. The hydrogen peroxide was a 30% (w/w) aqueous solution. The non-ionic wetting agent Triton X-100 was provided by Rohm and Haas Co., Philadelphia, Pa.

Tetrasodium pyrophosphate decahydrate was obtained from Aldrich Chemical Co., Inc., Milwaukee, Wis. All other chemicals used were of A.C.S. grade. All laboratory bleaching trials were carried out at a liquor/wool ratio of 30 milliliters to 1 gram of fabric.

BLEACHING

Bleaching was carried out under alkaline conditions for a specified time and temperature in the bleach bath of composition as listed below:

| Bleach Solution | |
|---|---|
| Hydrogen Peroxide | (30% w/w; 20.0 ml/liter) |
| Tetrasodium Pyrophosphate Decahydrate | (10.0 grams/liter) |
| Ammonium Persulfate (3.0 grams/liter) | (3.0 grams/liter) |
| Triton X-100 | (1.0 gram/liter) |

Aqueous Ammonia, if necessary, to PH 8.0–8.5. On addition of ammonium persulfate, the solution pH rapidly drops from about 9.4, to under 6. Sufficient ammonia is added to adjust pH back to 8.2–8.5.

pH (initial) = 6.00 pH (final) = 8.2–8.5

Using the formulations above, the following processes were carried out.

Process A: Bleaching with the above composition for 90 minutes at 60° C.;

Process B: As per process A for 60 minutes, then addition of thiourea (5.83 grams/liter), pH adjustment to 7–8 and continuation of bleaching for 3 minutes.

The results were as follows:

| | Whiteness Index (E-313) | Yellowness Index (D-1925) |
|---|---|---|
| Control | −4.40 ± 0.30 | 32.70 ± 0.16 |
| Process A | 11.59 ± 0.63 | 25.27 ± 0.24 |
| Process B | 16.43 ± 0.30 | 22.74 ± 0.10 |

The foregoing examples and detailed description s are given merely for purposes of illustration. Modifications and variations may be made therein without departing from the spirit and scope of the invention.

We claim:

1. A process for oxidative and reductive bleaching of fibers comprising:

contacting fibers with hydrogen peroxide and at least one persulfate containing compound under conditions which provide oxidative bleaching of said fibers to produce bleached fibers in contact with unspent hydrogen peroxide;

adding to said bleached fibers in contact with unspent hydrogen peroxide, an inactivating material in an amount at least sufficient to inactivate all of said unspent hydrogen peroxide to form an inactivated media; and subsequent to said inactivation of all unspent hydrogen peroxide, reductively bleaching said bleached fibers by addition of a reductive bleaching agent to said inactivated media.

2. The process of claim 1 wherein, said inactivating material is selected from the group consisting of: catalysts which catalyze decomposition of hydrogen peroxide, enzymes which decompose hydrogen peroxide, and materials which react with hydrogen peroxide to render said hydrogen peroxide inactive.

3. The process of claim 2 wherein, said inactivating material is a transition metal and the pH of said bleached fibers in contact with unspent hydrogen peroxide is adjusted to be from about 6 to about 10 prior to adding said transition metal.

4. The process of claim 3 further including the step of chelating excess metal ions by adding a chelating agent to said inactivated media prior to said reductive bleaching.

5. The process of claim 2 wherein said inactivating material is an enzyme and the pH of said bleached fibers in contact with unspent hydrogen peroxide is adjusted to be from about 3 to about 10 prior to adding said enzyme.

6. The process of claim 5 wherein said enzyme is catalase and said pH is adjusted from about 5 to about 8.5.

7. The process of claim 2 wherein said inactivating material is a material which reacts with hydrogen peroxide to render said hydrogen peroxide inactive, selected from the group consisting of cerium and quinone.

8. The process of claim 1 wherein said reductive bleaching agent is selected from the group consisting of thiourea dioxide or sodium hydroxymethanesulfinate.

9. The process of claim 1, wherein all steps are carried out batch-wise in a single bath.

10. The process of either claim 1, wherein all steps are carried out continuously using a continuous padding system.

11. The process of either claim 1, wherein said fibers are in a form selected from the group consisting of loose fiber, yarn and fabric.

12. The process of either claim 1, wherein said fibers are a material selected from the group consisting of animal hair fibers, plant fibers, synthetic fibers, and blends of two or more of said fibers.

13. The process of claim 12 wherein said fibers are a material selected from the group consisting of wool, wool blends, and cotton.

14. An essentially pigment free bleached fiber produced by the process of claim 1.

* * * * *